US006738985B2

(12) United States Patent
Hahn et al.

(10) Patent No.: US 6,738,985 B2
(45) Date of Patent: May 25, 2004

(54) DISPOSABLE SWEATBAND LINER

(76) Inventors: David S. Hahn, 12 Vista Ct., South San Francisco, CA (US) 94080; Kim Y. Hahn, 12 Vista Ct., South San Francisco, CA (US) 94080

( * ) Notice: Subject to any disclaimer, the term of this patent is extended or adjusted under 35 U.S.C. 154(b) by 0 days.

(21) Appl. No.: 10/074,187

(22) Filed: May 14, 2002

(65) Prior Publication Data

US 2003/0213049 A1 Nov. 20, 2003

(51) Int. Cl.[7] ..... A42C 5/00
(52) U.S. Cl. ..... 2/181; 2/181; 2/181.4
(58) Field of Search ..... 2/181, 181.4, DIG. 11, 2/209.13, 182.8, 60, 129, 135, 136

(56) References Cited

U.S. PATENT DOCUMENTS

| | | | | |
|---|---|---|---|---|
| 1,986,312 A | | 1/1935 | Wilson | |
| 2,003,886 A | | 6/1935 | Hoffeld | |
| 4,274,157 A | | 6/1981 | Boden | |
| 4,393,519 A | | 7/1983 | Nicastro | |
| 4,394,782 A | | 7/1983 | Wason | |
| 4,406,021 A | | 9/1983 | Bloom | |
| 4,468,817 A | | 9/1984 | Nunnery | |
| 4,502,156 A | | 3/1985 | Wishman | |
| 4,547,903 A | | 10/1985 | Brown | |
| 4,630,317 A | | 12/1986 | Brown | |
| 4,833,734 A | | 5/1989 | Del Estephanian | |
| 4,856,116 A | | 8/1989 | Sullvan | |
| 4,941,210 A | | 7/1990 | Konucik | |
| 4,947,488 A | | 8/1990 | Ashinoff | |
| 4,949,404 A | | 8/1990 | Fekete | |
| 5,025,504 A | | 6/1991 | Benston | |
| 5,046,196 A | | 9/1991 | Sullivan | |
| 5,058,210 A | | 10/1991 | Tivis | |
| 5,088,126 A | * | 2/1992 | Mathis | 2/181 |
| 5,313,668 A | * | 5/1994 | Bogan et al. | 2/181.4 |
| 5,317,761 A | | 6/1994 | Piche | |
| 5,432,955 A | | 7/1995 | Poltka | |
| 5,613,248 A | | 3/1997 | Young | |
| 5,632,046 A | | 5/1997 | Green | |
| 5,915,534 A | * | 6/1999 | May | 2/181.4 |
| 6,108,818 A | * | 8/2000 | Eisenberg | 2/181.2 |
| 6,477,715 B2 | * | 11/2002 | Shin | 2/181.4 |

* cited by examiner

*Primary Examiner*—Katherine Moran

(57) ABSTRACT

A disposable sweatband liner 10 made of a thin, flat and moisture absorbing material is shaped curved 28 to fit around the forehead of a person. A disposable sweatband liner is affixable to a cap, hat or sun visor by adhesive material 12. A disposable moisture absorbing sweatband strip is shaped to fit the forehead side headband of a cap, hat or sun visor. The disposable sweatband liner is folded in half where a slit 16 is notched for easy peel off of a peel off backing paper 14. The disposable sweatband liner 10 can be affixed and detached easily by a user as needed.

8 Claims, 2 Drawing Sheets

Fig. 1A
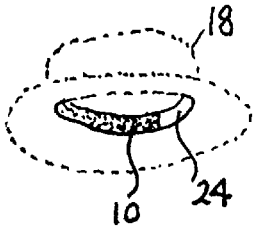
Fig. 1B
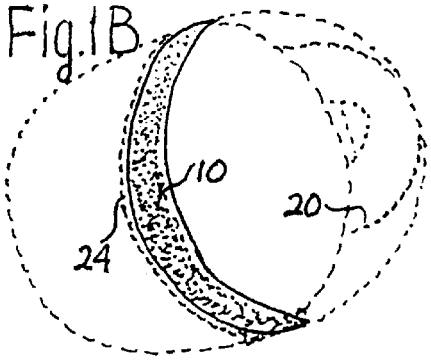
Fig. 1C
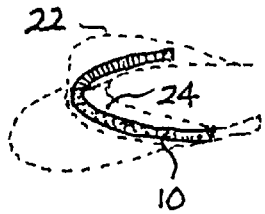
Fig. 2A
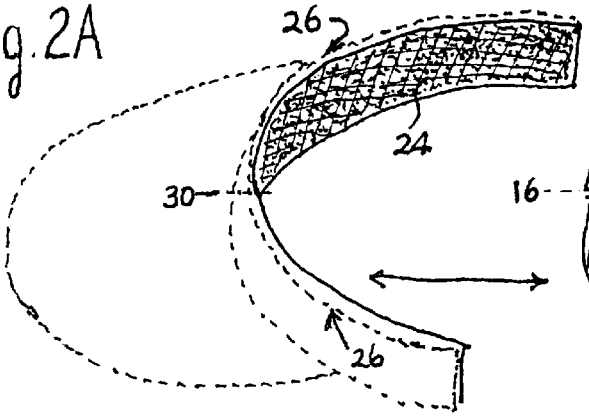
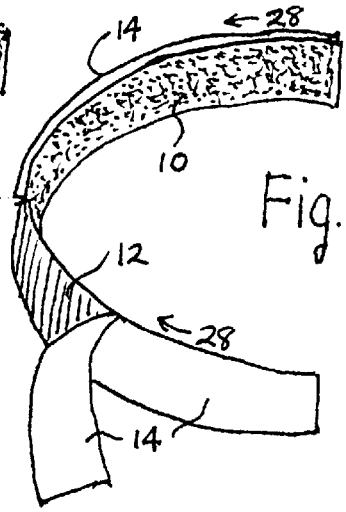
Fig. 2B
Fig. 3
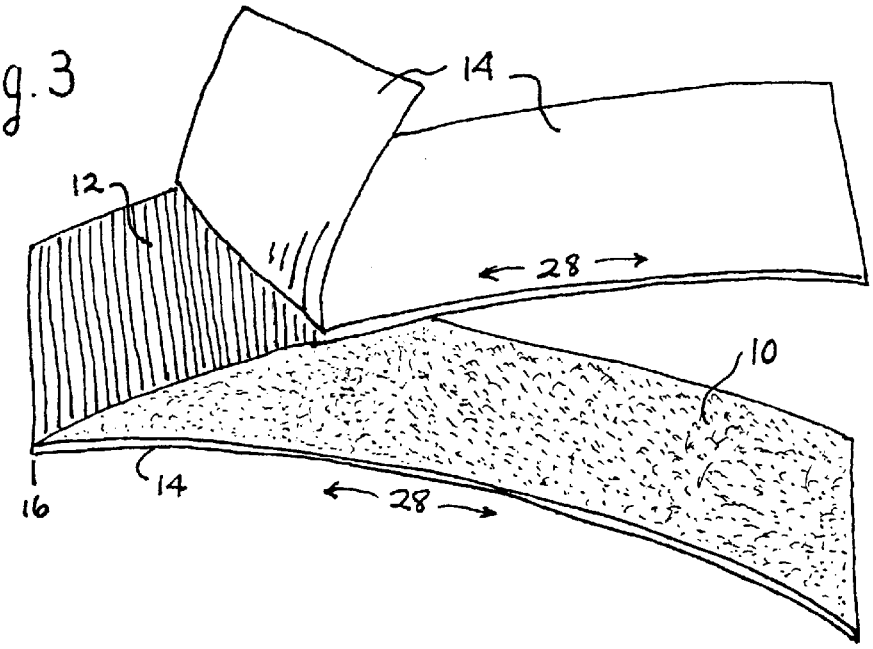

DISPOSABLE SWEATBAND LINER

CROSS-REFERENCES TO RELATED APPLICATIONS

Not applicable.

BACKGROUND

1. Field of Invention

This invention relates to sweatband apparatus, specially to such disposable applications which are affixed to a cap, hat or sun visor.

BACKGROUND

2. Description of Prior Art

The present invention relates to sweatband disposable applications which are affixed to a cap, hat or sun visor.

In the past, it has been common to have a variety of sweatbands four of sorting sweat on the forehead of an individual during sporting activities such as golf, tennis or baseball and/or outdoor activities. Typically, such sweatbands are a part of a cap, hat or sun visor. Such sweatbands are made of a moisture absorbing material to absorb the sweat on the forehead of an individual to prevent it from rolling down the face.

A number of prior U.S. Patents have dealt with sweatbands, and these include;

U.S. Pat. No. 1,986,312, issued to F. O. Wilson, on Jan. 1, 1935, which discloses a device for preventing the soiling of hats and headhears.

U.S. Pat. No. 2,003,886, issued to L. Hoffeld on Jun. 4, 1935, which discloses a combined sweatband and removable lining.

U.S. Pat. No. 4,274,157, issued to Ogden W. Boden on Jun. 23, 1981, which teaches a ventilated hat which has an adjustable band. The adjustable band is preferably formed as a moisture absorbing sweatband and allows circulation of air through a gap between two bands.

U.S. Pat. No. 4,393,519, issued to Norman J. Nicastro on Jul. 19, 1983, which teaches a headband which includes an absorbent material and elastic material. The headband encircles the head of the user and absorbs sweat.

U.S. Pat. No. 4,394,782, issued to John J. Wason on Jul. 26, 1983, which teaches a sweatband with an end fastners at each end.

U.S. Pat. No. 4,406,021, issued to Benard Bloom on Sept. 27, 1983, which teaches an uniform cap with adjustable sweatband. There are holes in the sweatband to be adjusted to fit through the holes.

U.S. Pat. No. 4,468,817, issued to Merle W. Nunnery on Sept. 4, 1984, which teaches a perspiration band for headgear, consisting of a terrycloth strip, with snap fastners for attachment to hat bands.

U.S. Pat. No. 4,502,156, issued to Marvin Wishman on Mar. 5, 1985, which teaches an improved nonwoven polypropylene fabric as a method of transferring moisture-bearing surface utilizing the fabric.

U.S. Pat. No. 4,547,903, issued to Larry L. Brown on Oct. 22, 1985, which teaches a sweatband shaped to fit around the head of a person and has strips of hook and loop material attached thereto for attaching a sun visor or cap.

U.S. Pat. No. 4,630,317, issued to Larry L. Brown on Dec. 23, 1986, which teaches a sweatband apparatus, with a sweatband attached to the inside of a cap with hook and loop fastners, e.g., VELCRO.

U.S. Pat. No. 4,833,734, issued to Mark Der Estephanian on May 30, 1989, which teaches a low cost sweatband which is formed of an elastic fabric core of a length to resilently encircle the head and an absorbent pad by stitching onto the elastic fabric.

U.S. Pat. No. 4,856,116, issued to Lloyd S. Sullivan on Aug. 15, 1989, which teaches a sweatband which has a first component for absorbing perspiration and a second component for holding the sweatband includes elongated ends, elastically extensible to opposite ends.

U.S. Pat. No. 4,941,210, issued to George J Konucik on Jul. 17, 1990, which teaches a quick change sweatband with a combination of hook pile fastners and the pad, quickly removed for replacement.

U.S. Pat. No. 4,947,488, issued to Leslie A. Ashnoff on Aug. 14, 1990, which teaches a forehead guard consisting of a closed loop of a terrycloth or similar stretch material tube and an attached semi-circular plastic shock absorbing member within the tube.

U.S. Pat. No. 4,949,404, issued to Joseph Fekete on Aug. 21, 1990, which teaches a liner for a hard-hat.

U.S. Pat. No. 5,025,504, issued to Phyllis S. Benston on Jun. 25, 1991, which teaches a liner for a helmet, hat, cap or other head covering which has a body with a central section and tapered end sections.

U.S. Pat. No. 5,058,210, issued to Victor L. Tivis on Oct. 22, 1991 and U.S. Pat. No. 5,088, 126, issued to Richard M. Mathis on Feb. 18, 1992 which discloses a disposable liner for safety hats and protective head coverings.

U.S. Pat. No. 5,046,196, issued to William W. Sullivan on Sep. 10, 1991, which teaches a cap which has a cover, a bill, a two-part adjustable band with standard adjustment apertures and fittings and a liner.

U.S. Pat. No. 5,317,761, issued to Bradley Piche on Jun. 7, 1994, which teaches a self-adhering absorbent disposable pads for headgears, which is of straight line and not tubular.

U.S. Pat. No. 5,432,955, issued to Arthur P. Poltka on Jul. 18, 1995, which teaches a quick release reusable sweatband, which is retained on the inside of a cap by hook and loop fastners.

U.S. Pat. No. 5,613,248, issued to Richard S. Young on Mar. 25, 1997, which teaches a sweat-band for a hat, that can be easily inserted and removed, comprising a flexible retaining strip by means of snap fastners.

U.S. Pat. No. 5,632,046, issued to Lawrence Green on May 27, 1997, which teaches a self-adjusting, fabric-covered sweatband for a hat.

In contrast to these prior patents, the present invention provides a disposable sweatband liner which can be replaced quickly and easily just by simply affixing it to an original headband of a cap, hat or sun visor to its concave curved portion. The disposable sweatband liner is folded in half at where the peel off backing paper is notched into a slit for easy applications.

SUMMARY

In accordance with the present invention a disposable sweatband liner, which is shaped with a curve to fit the forehead side headband of a cap, hat or sun visor, is provided with an easy peel off slit on backing paper at folded notch.

Objects and Advantages

Accordingly, besides the objects and advantages of the disposable sweatband liner described in my above patent, several objects and advantages of the present invention are:

(a) to provide sweatband liners which can be produced in a variety of materials, such as cotton terrycloth, or other moisture absorbing material;

(b) to provide a sweatband liner which can be produced for the convenience of being disposable, and soft and comfortable to the touch;

(c) to provide a sweatband liner which can be printed with advertisements on it;

(d) to provide a sweatband liner which creates clean and sanitized feeling to users by just affixing a fresh disposable sweatband liner;

(e) to provide a sweatband liner which can be used as hat sizers also;

(f) to provide a sweatband liner which can be used by restaurant employees as a clean and sanitized headgear alternative.

Further objects and advantages are to provide a sweatband liner which can be used conveniently and easily to prevent dirt and perspiration from accumulating on a cap, hat or sun visor, which is simple to use and inexpensive to manufacture, which can be supplied in a simple package. Still further objects and advantages will become apparent from a consideration of the ensuing description and drawings.

DRAWING FIGURES

In the drawings, closely related figures have the same number but different alphabetical suffixes.

FIGS. 1A to 1C show various aspects of applications such as 1A to a hat, 1B to a cap and 1C to a sun visor.

FIGS. 2A and 2B show where the present invention is affixed to, and how easy it is to apply by simply peeling off the backing paper (or plastic).

FIG. 3 shows a disposable sweatband liner consisting of a moisture absorbing liner (Numeral 10 with adhesive material on the back (Numeral 12), peel off backing paper or plastic (Numeral 14) and a backing paper slit (Numeral 16) at the folded notch for easy peel off.

REFERENCE NUMERALS IN DRAWINGS

Figure 4A:
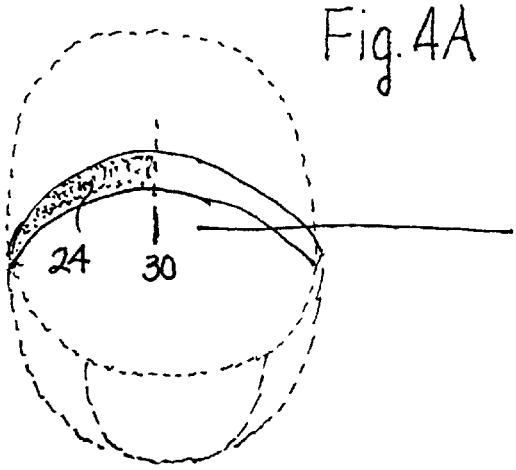
FIGS. 4A to 4E show how the present invention is applied in sequence; 4A and 4B show how to align the folded notch over the front center of a hat, cap or sun visor, 4C and 4D show how to peel off the backing paper starting from the center (from where there is a slit) and outward, 4E shows how to align a sweatband liner to a hat, cap or sun visor and smooth out the sweatband liner.

| | |
|---|---|
| 10 | moisture absorbing material band |
| 12 | adhesive material |
| 14 | peel off backing paper |
| 16 | backing paper slit at folded notch for easy peel off, and also folded notch |
| 18 | hat |
| 20 | cap |
| 22 | sun visor |
| 24 | original sweatband (headband) as a part of a cap, hat or sun visor |
| 26 | concave curved portion |
| 28 | curved design to fit around a headband of a cap, hat or sun visor |
| 30 | center of forehead of a headband of a cap, hat or sun visor. |

DESCRIPTION

FIGS. 1A, 1B, 1C, 2A, 2B and 3—Prefered Embodiment

A preferred embodiment of the disposable sweatband liner of the present invention is illustrated in FIG. 1A (with a hat), FIG. 1B (with a cap), FIG. 1C (with a sun visor), FIG. 2A where a disposable sweatband liner is affixed over an original headband or sweatband of a hat, cap or sun visor. Peel off backing paper 14 is peeled off starting from the folded notch (backing paper slit) 16, which is also considered as a lead-in notch that is shown at least in FIG. 2B as being substantially centrally located along the disposable sweatband liner 10, to be able to affix the disposable sweatband liner 10 to an original sweatband or headband 24. FIG. 2B curved design portion 28 is shaped to fit the forehead of an individual user which is also a concave portion 26 of a cap, hat, or sun visor.

The disposable sweatband liner of the present invention is folded in half (FIG. 3), where a slit 16 is notched for easy peel off of the backing paper 14. The disposable sweatband liner 10 is affixed to an original sweatband or headband 24 of a cap, hat or sun visor by adhesive material 12.

Referring now to FIG. 3 of the drawings, the disposable sweatband liner 10 is shaped with curved portion 28, advantageously, to fit around the forehead of an individual user, and made of moisture absorbing material such as terrycloth, cotton or other fabric. As shown in FIG. 3, as well as FIG. 2B, the disposable sweatband liner 10 includes a top side and a bottom side, both of which are shaped with the curved portion 28. In addition, the radii of curvature of top side and the bottom side are substantially the same. Peel off backing paper 14, shown partially peeled back, is make of paper or plastic which can be peeled from a slit 16 where is folded notched 16. Back side of the disposable sweatband liner has adhesive material 12 to affix to a headband of a cap, hat, or sun visor.

FIGS. 4A–4E—Additional Embodiments

Figure 4B:
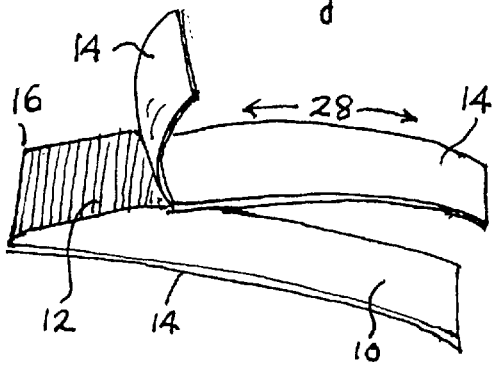
Figure 4C:
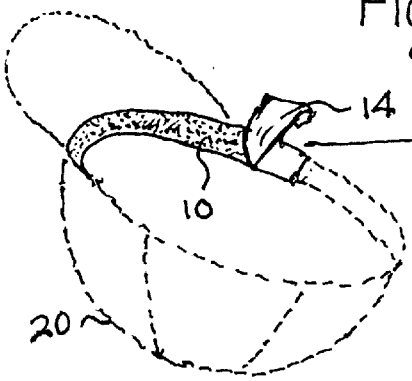
Figure 4D:
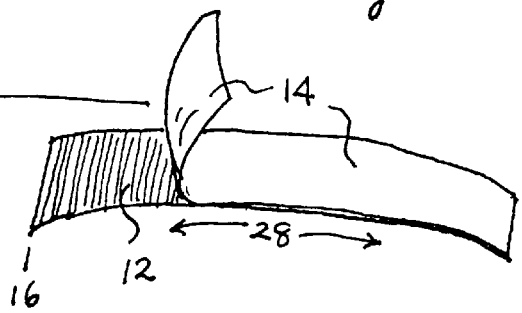
Figure 4E:
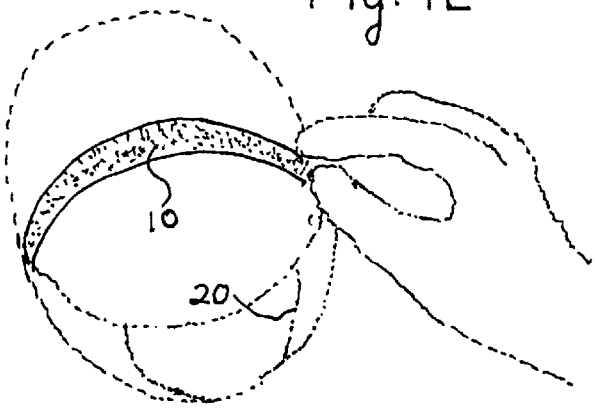

Additional embodiments are shown in FIGS. 4A, 4B, 4C, 4D and 4E; to where and how the disposable sweatband liner 10 is applied for use in sequence; FIGS. 4A and 4B show how to align at the folded notch 16 over the front center of a cap, hat or sun visor, and peel off the backing paper 14 shown partially peeled back, peeling backwards from the center 30 of forehead of a cap, hat or sun visor; FIGS. 4C and 4D show how to peel off backing paper 14 and affix the disposable sweatband liner 10 around the forehead side of a cap, hat or sun visor; FIG. 4E shows how to align a disposable sweatband liner 10 to a hat, cap or sun visor and smooth out the disposable sweatband liner 10.

Advantages

From the description above, a number of advantages of my disposable sweatband liner become evident;

(a) The present invention protects the integrity of an individual's favorite cap, hat or sun visor. With a disposable sweatband liner a cap, hat or sun visor can be kept looking like new.

(b) The disposable sweatband liner provides a cap, hat or sun visor in fresh and sanitary condition and protects the user's forehead from odors, stains or/and bacteria buildup.

(c) The disposable'sweatband liner is simple to use and inexpensive to manufacture and the same disposable sweatband liner can be left to be used many times over for an extended period of time.

(d) The present invention offers a curved shape and folded design with a notched slit for an easy application Conculsion, Ramification, and Scope Accordingly, the reader will see that the disposable sweatband liner of this invention can be used to prevent dirt buildup, to prevent stain buildup, to prevent odors buildup, to prevent bacteria buildup, to prevent make-up buildup, to prevent perspiration buildup, to prevent moisture buildup and to prevent a cap, hat or sun visor from becoming soiled. In addition, the disposable sweatband liner may be used on a used cap, hat or sun visor as well as on a new cap, hat or sun visor.

A cap, hat or sun visor is structured with a rim of the headband. The headband gets dirty, coloured and soiled where it contacts the forehead and/or dirty hair. Now the disposable sweatband liner is disposable and replaceable with a new disposable sweatband liner which is constructed with adhesive material, and it will keep a hat, cap or sun visor like new for a long period of time.

Although the descriptions above contains many specifications, these should not be construed as limited the scope of the invention but as merely providing illustrations of some of the presently preferred embodiments of this invention. For example, the disposable sweatband liner can have other shapes, such as wider, longer, narrower, shorter, etc.; the disposable sweatband liner can come in all different colors; the folded notch can be placed at other places; the peel off backing paper can be shaped as a butterfly shape for easy grip, etc.

Thus the scope of the invention should be determined by the appended claims and their legal equivalents, rather than by the examples given.

I claim:

1. A disposable sweatband liner comprising:

a first layer having a substantially curved shape and sized to extend over a substantial portion of a user's forehead, and wherein said first layer is composed of a moisture-absorbing material;

an adhesive applied to a first surface of the first layer;

a second layer having a shape similar to the first layer and removably attached to the first surface of the first layer to substantially cover said adhesive;

wherein said second layer comprises a slit located at a position substantially central to the second layer, wherein said slit generally enables removal of the second layer from a substantially central location of the first layer, and wherein the second layer is configured to be removed to generally expose the adhesive and enable the first layer to be removably adhered to a headwear device, and wherein the second layer comprises a pair of covers, each of said covers covering approximately one-half the size of the first surface.

2. The disposable sweatband liner of claim 1, wherein the moisture-absorbing material comprises at least one of cotton or terrycloth.

3. The disposable sweatband liner of claim 1, wherein the second layer comprises at least one of paper or plastic.

4. The disposable sweatband liner of claim 1, wherein the pair of covers is separated by said slit.

5. The disposable sweatband liner of claim 1, wherein the first layer has a top side and a bottom side, and wherein both the top side and the bottom side are curved.

6. The disposable sweatband liner of claim 5, wherein the top side and the bottom side both comprise substantially the same radius of curvature.

7. A method for protecting a sweatband lining of a headwear device, said method comprising:

providing a disposable sweatband having a first layer and a second layer, wherein said second layer substantially covers an adhesive applied to the first layer, and wherein said second layer comprises a slit located substantially centrally relative to the first layer;

folding the first layer at a substantially central location of the first layer to generally increase the width of the slit;

removing the second layer from the first layer by grasping the second layer substantially at the location of the slit and maneuvering the second layer in a direction substantially away from the first layer to thereby expose the adhesive on the first layer; and adhering the first layer onto the sweatband lining of the headwear device.

8. The method according to claim 7, wherein the step of adhering the first layer onto the sweatband lining of the headwear device comprises covering a substantial portion of the sweatband lining.

* * * * *